US010561236B2

(12) United States Patent
Qiang et al.

(10) Patent No.: US 10,561,236 B2
(45) Date of Patent: Feb. 18, 2020

(54) CONNECTOR APPARATUS

(71) Applicant: Whitmor, Inc., Southaven, MS (US)

(72) Inventors: Lu Zhi Qiang, ShenZhen (CN); Sandy Felsenthal, Memphis, TN (US)

(73) Assignee: Whitmor, Inc., Southaven, MS (US)

( * ) Notice: Subject to any disclaimer, the term of this patent is extended or adjusted under 35 U.S.C. 154(b) by 0 days.

(21) Appl. No.: 15/268,916

(22) Filed: Sep. 19, 2016

(65) Prior Publication Data

US 2018/0078036 A1 Mar. 22, 2018

(51) Int. Cl.
*A47B 47/02* (2006.01)
*A47B 57/48* (2006.01)

(52) U.S. Cl.
CPC ..... *A47B 47/027* (2013.01); *A47B 57/485* (2013.01)

(58) Field of Classification Search
CPC ..... A47B 57/34; A47B 57/485; A47B 57/265; A47B 57/545; A47B 57/26; A47B 57/06; A47B 57/562; A47B 47/027; A47B 47/0083; A47B 96/06; A47B 96/068; A47B 95/008
USPC ..... 403/398, 399
See application file for complete search history.

(56) References Cited

U.S. PATENT DOCUMENTS 3,640,498 A * 2/1972 Aleks ..... A47B 57/54 108/102
4,615,278 A * 10/1986 Cabrelli ..... A47B 57/265 108/147.13
6,015,052 A * 1/2000 Goldberg ..... A47B 57/545 108/106
6,044,988 A * 4/2000 Yang ..... A47B 57/265 108/107
6,068,143 A * 5/2000 Wang ..... A47B 57/265 108/144.11
6,253,933 B1 * 7/2001 Yang ..... A47B 57/545 108/147.12
7,059,484 B1 * 6/2006 Goldberg ..... A47B 47/0083 211/153
7,478,971 B2 * 1/2009 Li ..... A47B 57/545 108/147.13
8,408,405 B2 * 4/2013 Yang ..... A47B 57/26 108/108
8,640,893 B2 * 2/2014 Kessell ..... A47B 57/26 211/187
9,107,495 B2 * 8/2015 Lindo ..... A47K 3/281
(Continued)

*Primary Examiner* — Patrick D Hawn
(74) *Attorney, Agent, or Firm* — Stites & Harbison PLLC; Richard S. Myers, Jr.

(57) ABSTRACT

A connector component for use with a storage unit is provided. The connector component is configured to fit around and engage a frame support member of the storage unit and to receive and attach to an end portion of a shelving component used with the storage unit. The connector component can include a sidewall having two opposing ends. The sidewall can be configured in the form of a loop that forms an opening extending through the connector component, where the opening is configured to receive the frame support member of the storage unit. The connector component can further include a slot defined between the two opposing ends to allow the connector component to receive the frame support member. Each opposing end of the sidewall can include a channel extending along the height of the sidewall in order to receive and engage the end portion of the shelving component.

15 Claims, 5 Drawing Sheets

(56) References Cited

U.S. PATENT DOCUMENTS

| | | | | |
|---|---|---|---|---|
| 9,167,915 | B1 * | 10/2015 | Lau | A47B 47/0083 |
| 9,192,250 | B2 * | 11/2015 | Maurer | A47F 5/01 |
| 9,314,098 | B2 * | 4/2016 | Sabounjian | A47B 47/0083 |
| 9,380,868 | B1 * | 7/2016 | Fu | A47B 57/34 |
| 9,380,869 | B2 * | 7/2016 | Fu | A47B 57/545 |
| 9,468,294 | B2 * | 10/2016 | Fu | A47B 96/024 |
| 9,717,331 | B2 * | 8/2017 | Sabounjian | A47B 57/545 |
| 9,756,939 | B1 * | 9/2017 | Ruiz | A47B 61/04 |
| 2012/0217215 | A1 * | 8/2012 | Emery | A47K 3/281<br>211/119.009 |
| 2013/0313212 | A1 * | 11/2013 | Lindo | A47K 3/281<br>211/119.011 |
| 2016/0374467 | A1 * | 12/2016 | Gasparino | A47B 45/00<br>211/119.011 |

* cited by examiner

CONNECTOR APPARATUS

CROSS-REFERENCE TO RELATED APPLICATIONS

None.

FIELD OF THE INVENTION

The present invention is directed toward connector components, and in particular, connector components for use in storage units having shelves or racks to hold and store various items.

BACKGROUND OF THE INVENTION

Storage units with shelves or racks commonly incorporate connector components to secure each individual shelf or rack to the frame portion of the storage unit. The connector components need to be strong enough and stable enough to support the shelf or rack when items are placed and stored thereon. It is also desirable for the connector components to adequately secure the ends of each shelf or rack to the storage unit's frame, yet still allow for the shelf or rack to be selectively removable and adjustable along the height of the storage unit. Accordingly, a need exists for a connector component for use with a storage unit that allows for adequate selective attachment of shelves or racks to the frame portion of the storage unit.

SUMMARY OF THE INVENTION

The present invention is directed generally to a connector component for use with storage units having selectively removable shelves or racks. The connector component can include a sidewall having first and second ends that are positioned adjacent to one another in order to form the sidewall into a generally enclosed loop. The configuration of the sidewall can create an opening extending through the top and bottom of the connector component and the opening can be configured to receive a vertical frame member of the storage unit. The connector component can further include a connecting pin extending from the interior of the sidewall and into the opening. The connecting pin can be configured to engage an opening in the frame member in order to assist in securing the connector component to the frame member.

The two ends of the connector component sidewall can have channels defined along the height of the sidewall. The channels can be configured to partially receive and engage the ends of shelves or racks of the storage unit in order to assist in hanging the shelves or racks between the frame members of the storage unit. The channels can be formed by an outward curled or flared shape of the sidewall ends and/or by an indentation defined into the sidewall of the connector component.

The two ends of the connector component can further include grooves defined into the top edge of the connector component sidewall and above the channels in order to further assist in retaining the ends of the shelves or racks to the frame members of the storage unit.

The connector component can be used by attaching and securing the connector component to a frame member of the storage unit at a desired height. An end of the shelf or rack can then be positioned on the connector component so that a portion of the end of the shelf or rack is positioned within each channel and groove of the connector component. As a result, the end of the shelf or rack can remain connected to the connector component, and therefore the frame member of the storage unit, due to the frictional forces created between the shelf or rack end and the connector component channels and grooves.

Other aspects and advantages of the present invention will be apparent from the following detailed description of the preferred embodiments and the accompanying drawings figures.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
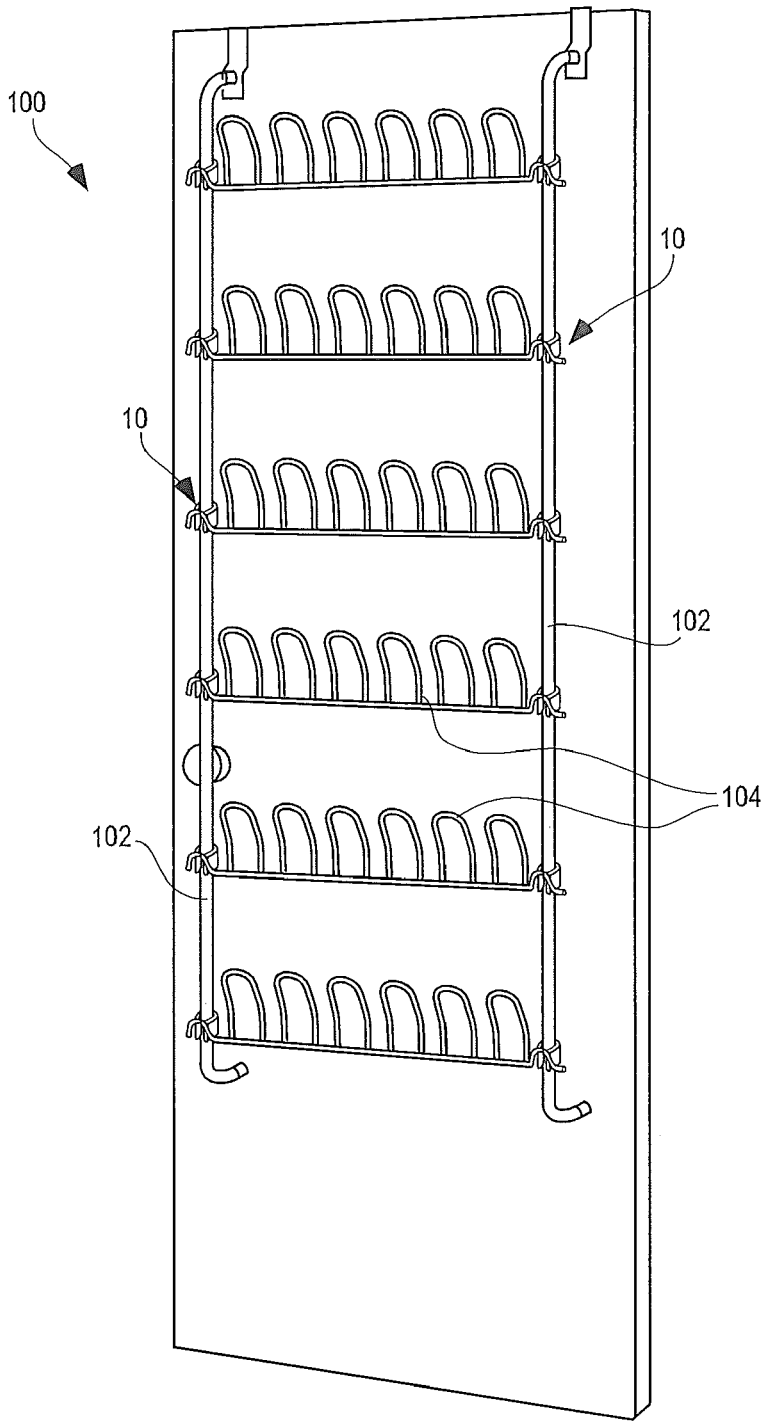
FIG. 1 is a perspective view of a storage unit having a plurality of connector components used to attach a plurality of shelving components to a frame of the storage unit in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

The present invention is directed to a connector component 10 that can be configured for use with a storage structure or unit 100, such as a wire frame storage rack or over-door hanging rack as illustrated in FIG. 1. One or more connectors 10 can be attached to frame support members 102 of storage unit 100 and can be used to connect and secure shelving components or racks 104 to the frame support members 102 as described in greater detail below. As shown in FIG. 1 (and also in FIGS. 8 and 9), storage unit 100 can include two or more frame support members 102 from which a plurality of racks or shelving components 104 are suspended between. Such frame support members 102 and shelving components 104 are commonly constructed from metal or plastic rods, bars, tubes or wire-frames. Connectors 10 can be secured around frame support members 102 and configured to receive and retain the ends 106 of shelving components or racks 104 between frame support members 102. Connectors 10 can also be configured to be selectively removable from frame support members 102 and configured to allow shelving components or racks 104 to be selectively removable from connectors 10. It is recognized that the embodiments of storage unit 100 as illustrated in the figures are intended for exemplary purposes only and connector 10 can be suitably configured for use with many different configurations or types of storage unit 100.

Turning now to FIGS. 2-5, connector 10 will be described in greater detail. Connector 10 can be constructed from any suitable material, such as a plastic, rubber or poly-based material that can provide connector 10 with a semi-flexible configuration. According to one embodiment, connector 10 can be designed with a resilient nature so that connector 10 can be flexed or manipulated to fit around frame support member 102 (as described below) and then transition back to its original shape. In alternative embodiments, connector 10 can be configured so that it can be selectively molded or otherwise positioned around frame support member 102.

Figure 3:
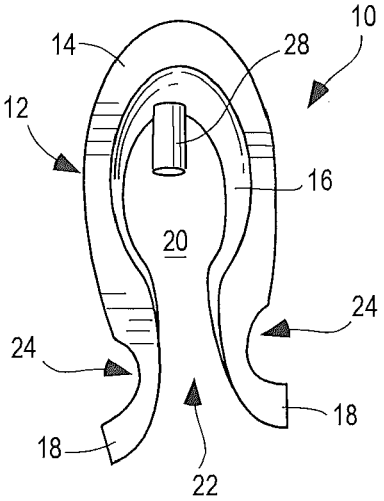
FIG. 3 is a top perspective view of the connector component of FIG. 2.

As best shown in FIG. 3, connector 10 can include a sidewall 12 having a top edge 14, an interior sidewall surface 16 and opposing ends 18. Sidewall 12 can be sized and shaped, along with interior surface 16, to define a partially enclosed loop configuration where opposing ends 18 are positioned generally adjacent to one another. The loop configuration can allow for the formation of an opening 20 extending generally vertically through connector 10. As also best shown in FIG. 3, opposing ends 18 can remain separated from one another in order to define a slot 22 that can allow access to opening 20 through sidewall 12. Opening 20 can be configured for receiving (via slot 22) one of the frame support members 102 of storage unit 100 as described in greater detail below.

Figure 2:
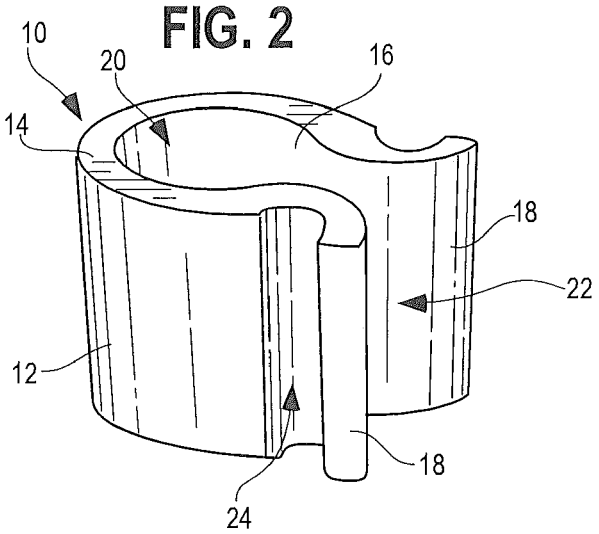
FIG. 2 is a side perspective view of a connector component configured for use with a storage unit in accordance with one embodiment of the present invention.
Figure 5:
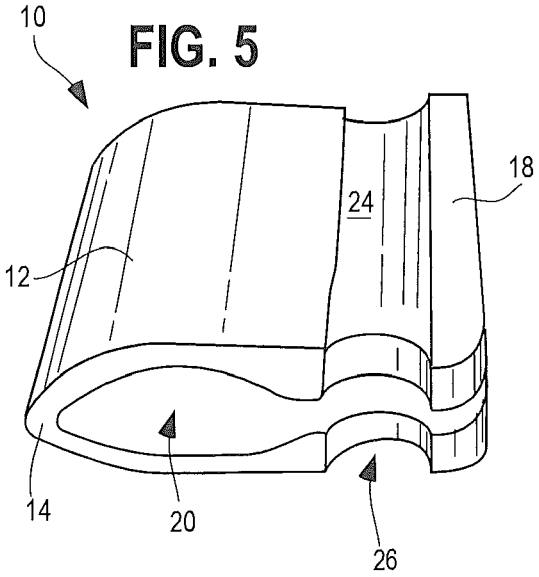
FIG. 5 is a top perspective view of the connector component of FIG. 4.

As best shown in FIGS. 2 and 5, each end 18 of connector 10 can include a generally vertically orientated channel 24. Channels 24 can be configured for at least partially receiving one of the ends 106 of shelving components 104 in order to allow the particular shelving component 104 to be connected to frame support member 102 of storage unit 100. According to one embodiment as shown in FIGS. 2 and 3, channels 24 can be formed by an outwardly-curved or outwardly-flared shape of ends 18. In addition to the curved/flared shape of ends 18, or alternatively, channels 24 can be defined by or formed as an indentation extending at least partially into the outer surface of sidewall 12 as illustrated in FIGS. 4 and 5.

Figure 4:
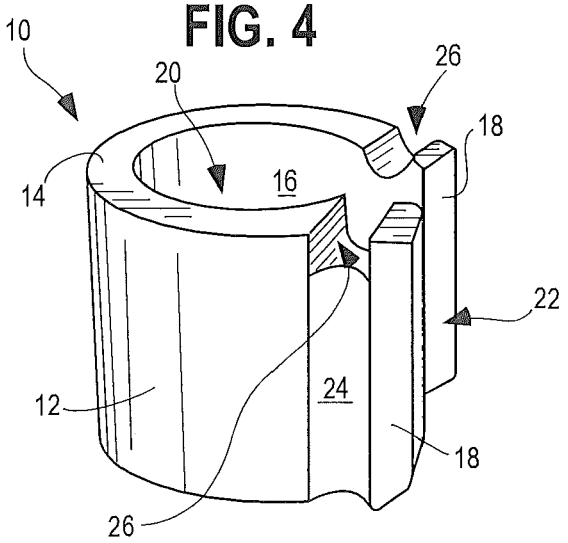
FIG. 4 is a side perspective view of a connector component configured for use with a storage unit in accordance with another embodiment of the present invention.

As best shown in FIGS. 4 and 5, top edge 14 of sidewall 12 can include a groove or notch 26 above each channel 24. As shown, each groove 26 can be generally aligned with its corresponding channel 24. Grooves 26 can be configured to assist in receiving and retaining end 106 of one of the shelving components 104 of storage unit 100. Accordingly, grooves 26 can have a rounded shape approximately sized and shaped to generally conform to the size and shape of ends 106 of each shelving component 104.

As best shown in FIG. 3, connector 10 can include a connecting pin or protrusion 28 configured for assisting in securing connector 10 around frame support member 102 of storage unit 100. Connecting pin 28 can extend from interior surface 16 of sidewall 12 and into opening 20. As shown in FIG. 3, pin 28 can be located near the back of sidewall 12 (generally opposite of slot 22); however, pin 28 can also be positioned anywhere along sidewall 12. In addition, in certain embodiments (not shown), connector 10 can include more than one connecting pin 28 at different locations along interior surface 14 of sidewall 12. Connecting pin 28 can generally correspond to an opening 108 defined in frame support member 102. Accordingly, when connector 10 is attached to frame support 102, connecting pin 28 can be inserted into opening 108 in order to assist in securing connector 10 around frame support member 102.

Figure 6:
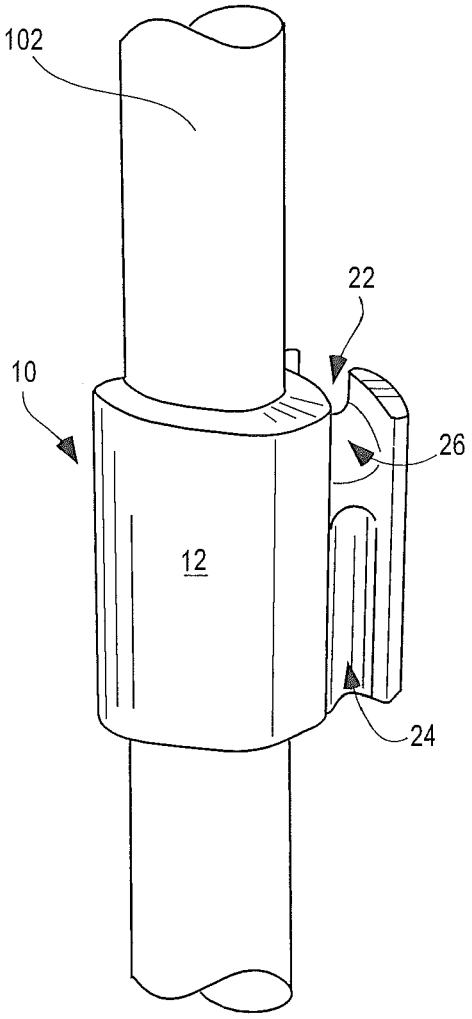
FIG. 6 is a rear perspective view of a connector component attached around a frame support member of a storage unit in accordance with one embodiment of the present invention.
Figure 7:
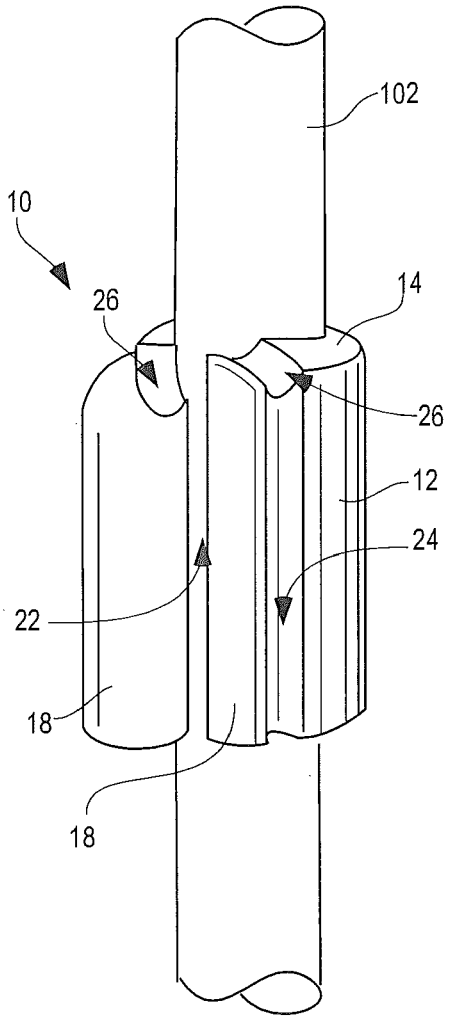
FIG. 7 is a front perspective view of the connector component of FIG. 6.

Turning now to FIGS. 6-9, connector 10 when used in conjunction with storage unit 100 will be described in greater detail. As shown in FIGS. 6 and 7, each connector 10 can be positioned onto frame support member 102 by inserting frame support member 102 through slot 22 and into opening 20 so that interior surface 16 of sidewall 12 engages frame support member 102. In addition, connecting pin 28 can be inserted into the corresponding opening 108 of frame support 102 (as best shown in FIG. 7) in order to secure and retain connector 10 around frame support 102. Prior to placing connector 10 onto frame support member 102, connector 10 (and ends 18) can be configured to be in a first or original position where ends 18 are positioned generally adjacent to one another and sidewall 12, and interior surface 16, generally conform to the shape of frame support member 102. The flexible nature of connector 10 can then allow for the opposing ends 18 of connector 10 to be flexed or otherwise moved apart to place connector 10 (and ends 18) in an expanded or flexed position. The expanded position of connector 10 (and ends 18) can allow frame support member 102 to be inserted through slot 22 and into opening 20. Once frame support member 102 is fully positioned within opening 20, the resilient nature of connector 10 can allow opposing ends 18 to move back toward one another and connector 10 can return to its original position.

Figure 8:
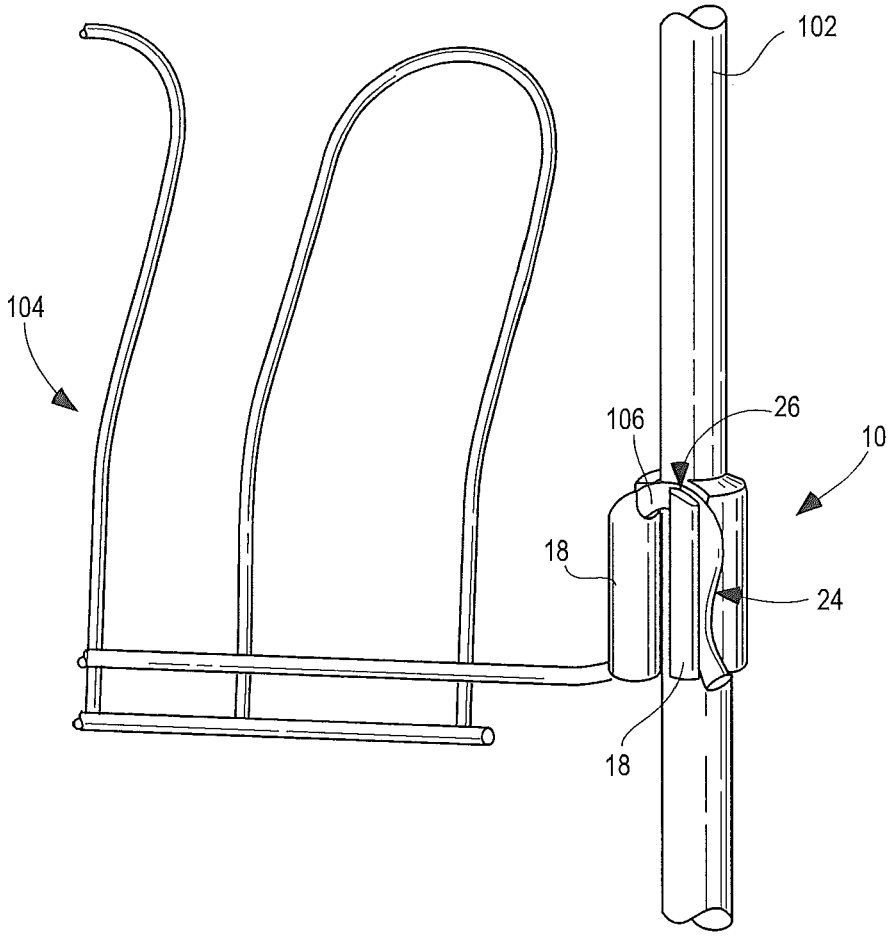
FIG. 8 is a front perspective view of a connector component attached to a frame member support of a storage unit, illustrating the connector component supporting a shelving component of the storage unit in accordance with one embodiment of the present invention.
Figure 9:
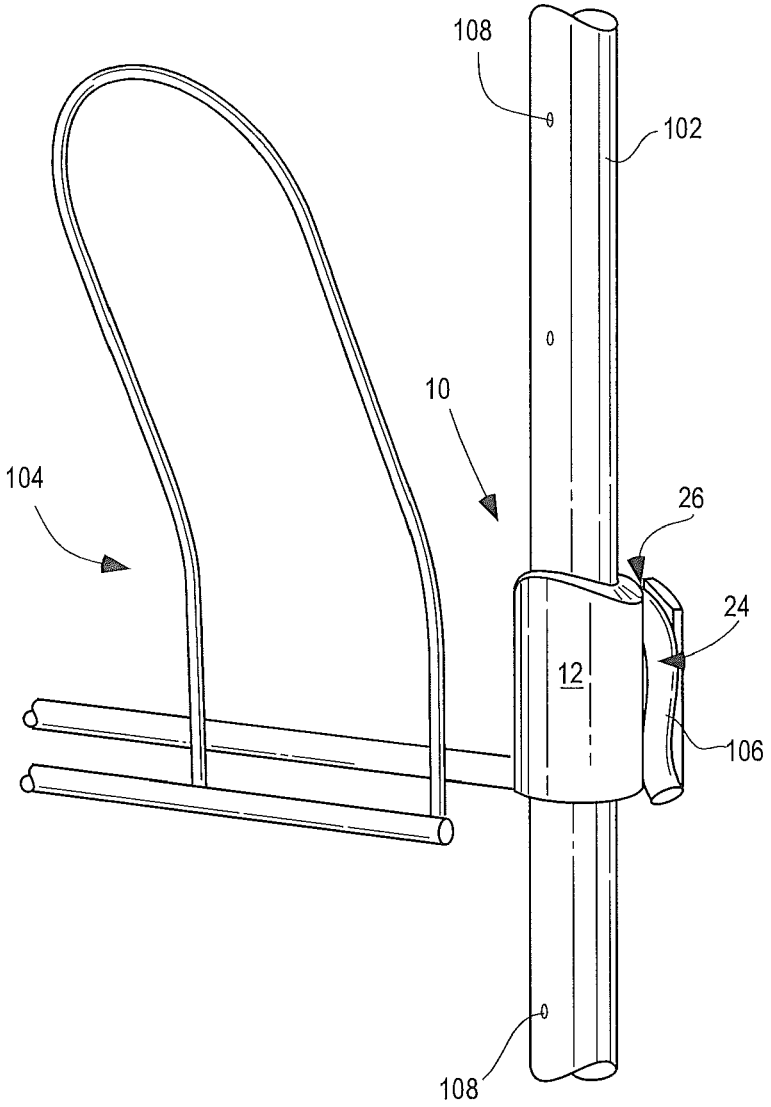
FIG. 9 is a rear perspective view of the connector component of FIG. 8.

As shown in FIGS. 8 and 9, one of the ends 106 of a shelving component 104 can be placed onto and/or around ends 18 of connector 10 so that the shelving component end 106 is located at least partially within channels 24 and/or grooves 26 of each connector end 18. As best shown in FIG. 8, shelving component end 106 can extend upward along channel 24 of the "interior" end 18 of connector 10, over slot 22 and then downward along channel 24 of the opposing "exterior end 18 of connector 10. As also shown in both FIGS. 8 and 9, at least at portion of end 106 can be configured to fit within grooves 26 of each end 18 in order to further secure end 106 to connector 10. The engagement between channels 24 and grooves 26 of connector 10 and end 106 of shelving component 104 can create frictional forces sufficient to adequately secure end 106 of shelving component 104 to connector 10, and therefore frame support member 102. The procedures described above can be completed for each connector 10 and shelving component 104 in order to construct storage unit 100 as shown in FIG. 1.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required." Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A connector component for use with a storage unit having at least one shelving component, said connector component comprising:

a sidewall having two opposing lateral ends, said sidewall formed into a substantially u-shaped loop with an opening extending transversely through said loop and defining a gap between the lateral opposing ends, a first channel recessed into said sidewall and adjacent to a first end of said two opposing lateral ends, said first channel extending throughout the height of said sidewall; and a first groove defined into a top edge of said sidewall, wherein said first groove is aligned with said first channel;

wherein said opening is configured for receiving and holding a frame member of said storage unit and said first channel is configured for at least partially receiving an end portion of said at least one shelving component;

wherein said opening continues to define the gap after the connector component receives and holds said frame member; and wherein said sidewall is constructed from a semi-flexible and resilient material that allows said two opposing ends to flex apart from an original position to an expanded position and elastically transition toward the original position, so that said connector component can receive said frame member through a gap defined between said two opposing ends and into said opening.

2. The connector component of claim 1 further comprising a second channel recessed into said sidewall and adjacent to a second end of said two opposing ends, wherein said second channel extends at least partially along said height of said sidewall.

3. The connector component of claim 1, wherein said two opposing ends curve outwardly from the interior of the loop.

4. The connector component of claim 1, further comprising:

a second channel recessed into said sidewall and adjacent to a second end of said two opposing ends, wherein said second channel extends at least partially along said height of said sidewall; and a second groove defined into said top edge of said sidewall, wherein said second groove is aligned with said second channel.

5. The connector component of claim 4, wherein said end portion of said at least one shelving component is configured to extend at least partially along said first channel, over said gap, and at least partially along said second channel.

6. The connector component of claim 1 further comprising a connecting pin extending from an interior surface of said sidewall and into said opening, said connecting pin configured to engage a frame member opening defined in said frame member for assisting in securing said connector component to said frame member.

7. The connector component of claim 1, wherein an interior surface of said sidewall is configured to conform to said frame member.

8. A storage unit having at least one frame member, at least one shelving component and at least one selectively removable connector component, said connector component comprising:

a sidewall having a first end, a second end, and an upper edge, wherein said sidewall is configured into a substantially u-shaped loop where said first and said second ends are positioned adjacent to one another with a gap extending therebetween and defining a distance between the first and second ends;

a first channel recessed into said sidewall and extending throughout the height of said sidewall adjacent to said first end;

a second channel recessed into said sidewall and extending throughout the height of said sidewall adjacent to said second end; and a first groove defined into said top edge of said sidewall, wherein said first groove is aligned with said first channel;

wherein said sidewall is configured to fit around and attach to said at least one frame member, said sidewall being constructed from a semi-flexible and resilient material that allows said two opposing ends to flex apart from an original position to an expanded position and elastically transition toward the original position, so that said connector component can receive said frame member through a gap defined between said two opposing ends and into said opening;

wherein said at least one shelving component includes an end portion configured to at least partially engage said first channel of said connector component, extend over said first and said second ends of said connector component and at least partially engage said second channel; and wherein said gap remains defined after the connector is attached to the frame member.

9. The storage unit of claim 8, wherein said connector component further comprises a second groove defined into said top edge of said sidewall, wherein said second groove is aligned with said second channel.

10. The storage unit of claim 8, wherein said connector component further comprises a connecting pin extending from an interior surface of said sidewall and into said opening, said connecting pin configured to engage a frame member opening defined in said at least one frame member for assisting in securing said connector component to said at least one frame member.

11. The storage unit of claim 10, wherein said interior surface of said sidewall conforms to said at least one frame member.

12. The storage unit of claim 8, wherein said connector component is constructed from a semi-flexible material that allows said first and said second ends to flex apart from an original position to an expanded position so that said connector component can receive said at least one frame member through said gap and into said opening.

13. The storage unit of claim 12, wherein said first and said second ends are configured as resilient opposing ends such that when said connector component is placed onto said frame member, said resilient opposing ends return to said original position.

14. The storage unit of claim 8, wherein a plurality of said connector components are adaptable to hang said at least one shelving component from said at least one frame member.

15. The storage unit of claim 8, wherein said end portion of said at least one shelving component is constructed as a wire frame member.

* * * * *